US006712671B2

(12) United States Patent
Wallendorf et al.

(10) Patent No.: US 6,712,671 B2
(45) Date of Patent: Mar. 30, 2004

(54) DEVICE FOR EDGE-MACHINING OF OPTICAL LENSES

(75) Inventors: Steffen Wallendorf, Giessen-Kleinlinden (DE); Holger Schäfer, Weilmünster (DE)

(73) Assignee: Loh Optikmaschinen AG (DE)

( * ) Notice: Subject to any disclaimer, the term of this patent is extended or adjusted under 35 U.S.C. 154(b) by 118 days.

(21) Appl. No.: 10/103,150

(22) Filed: Mar. 21, 2002

(65) Prior Publication Data

US 2002/0168920 A1 Nov. 14, 2002

(30) Foreign Application Priority Data

Mar. 22, 2001 (DE) ..... 101 14 239

(51) Int. Cl.[7] ..... B24B 49/00
(52) U.S. Cl. ..... 451/11; 451/57; 451/44
(58) Field of Search ..... 451/57, 65, 42, 451/43, 44, 10, 11, 240, 255, 256, 277, 323

(56) References Cited

U.S. PATENT DOCUMENTS

| | | | | |
|---|---|---|---|---|
| 1,740,551 A | | 12/1929 | Robinson | |
| 4,179,851 A | | 12/1979 | Neisler et al. | |
| 5,904,613 A | | 5/1999 | Lauderich | |
| 6,110,017 A | * | 8/2000 | Savoie et al. | 451/42 |
| 6,325,697 B1 | * | 12/2001 | Gottschalk | 451/5 |
| 6,394,892 B2 | * | 5/2002 | Hanisch et al. | 451/259 |
| 6,523,443 B1 | | 2/2003 | Hof et al. | |
| 6,602,110 B2 | * | 8/2003 | Yi et al. | 451/9 |

FOREIGN PATENT DOCUMENTS

| | | |
|---|---|---|
| DE | 3418329 A1 | 11/1995 |
| DE | 196 43 546 C2 | 8/1998 |
| DE | 298 23 464 U1 | 7/1999 |
| EP | 0 849 038 A2 | 6/1998 |
| EP | 0 917 929 A2 | 5/1999 |
| JP | 57-173447 | 10/1982 |
| WO | WO 97/13603 | 4/1997 |
| WO | WO 01/70461 A1 | 3/2001 |

* cited by examiner

*Primary Examiner*—Dung Van Nguyen
(74) *Attorney, Agent, or Firm*—McAndrews, Held & Malloy, Ltd.

(57) ABSTRACT

A device is disclosed for edge-machining an optical lens, clampable between two aligned holding shafts rotatable about the rotational axis of a workpiece, having a Z slide, which is guided longitudinally displaceably on a base frame in a Z direction parallel to the rotational axis of the workpiece, and an X slide bearing a tool post with an edge-machining tool, which is guided longitudinally displaceably on the Z slide in an X direction perpendicular to the Z direction in such a way that the edge-machining tool may be brought into machining engagement with the optical lens. For industrial use, the base frame is of substantially O-shaped construction and surrounds the Z slide, wherein the Z slide is likewise of substantially O-shaped construction and surrounds the X slide. In addition or as an alternative thereto, provision is made for an additional machining means to be fixed to the X slide, which means comprises at least one further edge-machining tool, which may be moved from a parked position into a machining position between the lens and the edge-machining tool on the tool post.

29 Claims, 8 Drawing Sheets

DEVICE FOR EDGE-MACHINING OF OPTICAL LENSES

BACKGROUND OF THE INVENTION

The invention relates to a device for edge-machining of an optical lens. In particular, the invention relates to a CNC-controlled device, suitable for industrial use, for edge-machining of spectacle lenses, which allows spectacle lenses to be finish-machined at the edges even in relatively large numbers with the necessary precision in very short machining times.

Where the term spectacle lenses is used below, it should be understood to mean optical lenses or lens blanks for spectacles made of the usual materials, such as polycarbonate, inorganic glass, CR-39, HI-Index etc., and with circumferential edges of any shape, which lenses or lens blanks may be, but do not have to be, machined on one or both optically effective surfaces prior to machining of the edge thereof.

In the field of spectacle lens edge machining, the aim of which is to finish-machine the edge of a spectacle lens in such a way that the spectacle lens may be inserted into a spectacle frame, a trend has recently begun to emerge for this demanding machining to be relocated away from the opticians' workshops to the spectacle lens manufacturers in particular for reasons of rationalisation. When carried out by the spectacle lens manufacturers, this procedure requires spectacle lens machining machines, also known as "edgers", which may quickly edge-machine the widest possible range of spectacle lenses with the required precision without much effort being required for setting up and may be used reliably for long periods.

DESCRIPTION OF THE PRIOR ART

In the prior art, there is no shortage of proposals for speeding up the edge-machining of spectacle lenses. For instance, the generic EP-A-0 917 929 discloses an edger for spectacle lenses which, to increase efficiency during machining, comprises two tool posts which are arranged parallel to the vertically extending axis of rotation of the spectacle lens to be edge-machined and are each provided with a set of grinding wheels. The one set of grinding wheels comprises a rough-grinding wheel and an intermediate grinding wheel provided with various grooves for beveling, while the other set of grinding wheels comprises a similar rough-grinding wheel and a finish-grinding wheel provided with beveling grooves for finishing. For each tool post there is provided an (X-Z) compound slide arrangement, with a vertical slide and a horizontal slide. On one side, the vertical slide is guided displaceably in the vertical direction on a machine frame while, on the other side of the vertical slide, the horizontal slide is guided displaceably in the horizontal direction. On the side remote from the vertical slide, the horizontal slide bears the respective tool post. By means of CNC-controlled slide drives, each tool set may be moved in a radial direction relative to the spectacle lens to be machined and parallel to the axis of rotation of the spectacle lens. The spectacle lens to be machined is clamped between two coaxial spectacle lens holding shafts, of which the lower spectacle lens holding shaft is arranged stationarily while the upper spectacle lens holding shaft can be moved relative to the lower spectacle lens holding shaft only in the direction of the workpiece axis. Finally, a CNC-controlled rotary actuator is provided for each spectacle lens holding shaft, such that the previously known edger is controlled in altogether 6 CNC axes. The rotary actuators are CNC-coupled for simultaneous rotation of the spectacle lens to be machined.

A spectacle lens edge grinding machine has also been proposed for speeding up edge-machining of spectacle lens (U.S. Pat. No. 4,179,851, DE-A-34 18 329), which, reversing the above conditions, has a grinding wheel set which is rotatable about a horizontally extending axis of rotation but is otherwise stationary. Moreover, this machine comprises two pairs of coaxial spectacle lens holding shafts for simultaneous edge-machining of two spectacle lenses, which holding shafts are oriented parallel to the axis of rotation of the tool. An (X-Y) cross slide arrangement is associated therein with each pair of spectacle lens holding shafts, such that the respective spectacle lens clamped between the spectacle lens holding shafts and to be edge-machined may be moved in the radial direction relative to the grinding wheel set and parallel to the axis of rotation of the grinding wheel set.

Finally, DE-U-298 23 464 discloses a concept in which a conventional machining machine for shaping the left spectacle lens and a further conventional machining machine for shaping the right spectacle lens are linked together via a conveying means and a handling apparatus for accelerated production of the left and right spectacle lenses for a spectacle frame.

Edge-machining of spectacle lenses may in principle indeed be speeded up with the above-described known methods. However, for industrial use, in which it is also necessary to machine relatively large numbers over relatively long periods without problems arising with regard to machining quality, the known methods appear to be suitable to only a very limited extent, in particular with respect to their mechanical structure.

For the sake of completeness, it should also be mentioned in this context that the prior art also includes proposals to provide an additional tool on a spectacle lens edger, which tool serves to form channels on the periphery of the shaped spectacle lens or bores or grooves in the spectacle lens and/or to bevel or chamfer the edges of the spectacle lens. This additional tool renders it unnecessary to transfer the spectacle lens to or reclamp it in a further machining machine and in this respect also speeds up edge-machining. In this context, methods are known in which (1) the additional tool is stationary with regard to the main tool, which may be moved in two mutually perpendicular directions by means of a compound slide arrangement, and is driven by the rotary actuator of the main tool (DE-A-43 08 800), (2) the additional tool may be swiveled relative to a stationary main tool from a rest position into a machining position, in order to enter into drive connection with the main tool and into machining engagement with the spectacle lens (EP-A-0 820 837), as are methods in which (3) the additional tool, provided with its own rotary actuator, may be swiveled relative to a stationary main tool from a rest position into a machining position, in order to come into machining engagement with the spectacle lens (DE-A-198 34 748).

SUMMARY OF THE INVENTION

The object of the invention is to provide a device of the simplest possible, compact construction for edge-machining an optical lens, in particular a spectacle lens, which meets industrial requirements with regard to throughput and machining quality.

According to one aspect of the present invention, there is provided a device for edge-machining an optical lens, which may be clamped between two aligned holding shafts rotatable about a rotational axis of a workpiece, having a first slide, which is guided longitudinally displaceably on a base frame in a first direction parallel to the rotational axis of the workpiece, and a second slide bearing a tool post with an edge-machining tool for the optical lens, which slide is guided longitudinally displaceably on the first slide in a second direction perpendicular to the first direction in such a way that the edge-machining tool may be brought into machining engagement with the optical lens; wherein the base frame is of substantially O-shaped construction and surrounds the first slide, and wherein the first slide is likewise of substantially O-shaped construction and surrounds the second slide. In other words, the slides are nested telescopically inside one another relative to one another and to the base frame, respectively, in an open rectangular frame construction.

According to a second aspect of the present invention, there is provided a device for edge-machining an optical lens, which may be clamped between two aligned holding shafts rotatable about a rotational axis of a workpiece, having a first slide, which is guided longitudinally displaceably on a base frame in a first direction parallel to the rotational axis of the workpiece, and a second slide bearing a tool post with an edge-machining tool for the optical lens, which slide is guided longitudinally displaceably on the first slide in a second direction perpendicular to the first direction in such a way that the edge-machining tool may be brought into machining engagement with the optical lens; wherein an additional machining means is fixed to the second slide, which means comprises at least one further edge-machining tool for the optical lens, which is movable from a parked position into a machining position between the optical lens and the edge-machining tool on the tool post.

In the case of a device for edge-machining an optical lens, in particular a spectacle lens, which may be clamped between two aligned holding shafts rotatable about the rotational axis of a workpiece, having a first slide, which is guided longitudinally displaceably on a base frame in a first direction parallel to the rotational axis of the workpiece, and a second slide bearing a tool post with an edge-machining tool for the optical lens, which is guided longitudinally displaceably on the first slide in a second direction perpendicular to the first direction in such a way that the edge-machining tool may be brought into machining engagement with the optical lens, the base frame is of substantially O-shaped construction and surrounds the first slide, wherein the first slide is likewise of substantially O-shaped construction and surrounds the second slide.

Together with a compact construction, such a device exhibits very high rigidity due to the closed force flow established by the O-shaped construction of the base frame, which rigidity allows higher speeds and acceleration rates to be achieved during adjustment movements and, where technologically possible, also during feed movements than was possible with conventional edgers. Tests performed by the applicant have shown that the times necessary for edge-machining are significantly reduced by the construction of the device according to the invention relative to the previously known edgers using comparable edge-machining tools (grinding wheels, milling cutters or combinations thereof) and thus productivity may be markedly increased without this being detrimental to machining quality. Even in the case of extended use, as is usual with industrial manufacture, a uniformly good machining quality is achieved, because the O-shaped construction of the base frame and the first slide likewise ensures thermal symmetry, in which the thermal expansions caused by heating up of the drive and machining components involved are mutually compensated.

Embodiments of the edge-machining device are disclosed which are advantageous especially from the point of view of thermally invariable behaviour. For instance, a linear guide for the first slide may be provided on each side of the base frame, wherein the linear guides extend parallel to one another on the base frame. Each linear guide for the first slide may comprise a guide rail attached to the base frame and two guide shoes engaging with the guide rail, which guide shoes are fixed to the first slide in symmetrical arrangement. A linear guide for the second slide may be provided on each side of the first slide, wherein the linear guides extend parallel to one another on the first slide. Finally, each linear guide for the second slide may comprise a guide rail attached to the first slide and two guide shoes engaging with the guide rail, which guide shoes are fixed to the second slide in symmetrical arrangement.

The first slide and/or the second slide is preferably movable by means of a hollow shaft servo motor, which comprises a rotatable nut, which is in active engagement with a non-rotatable ball screw. This embodiment of the device advantageously allows further optimisation of the speeds and acceleration rates of the adjustment and feed movements, together at the same time with good linear positioning accuracy and reduced structural space requirements relative to known designs with additional transmission elements, such as drive belts or clutches. This optimisation potential during adjustment and feed movements is primarily attributable to the fact that the non-rotatable arrangement of the ball screw, which renders unnecessary the end bearings which are necessary with rotating spindles and limit axial force, ensures increased axial rigidity and elevated torsional rigidity of the ball screw. In addition, the problem of critical whirling speeds does not arise with a non-rotatable ball screw. All in all, higher speeds and acceleration rates are possible.

The hollow shaft servo motor for the first slide may be attached to the base frame, while the ball screw is preferably attached non-rotatably and centrally on the first slide. This has the advantage on the one hand that the hollow shaft servo motor, which is thus stationary, does not have also to be accelerated or braked during adjustment and feed movements. On the other hand, the central position of the ball screw on the first slide advantageously ensures that no tilting moments are introduced into the first slide, which could inter alia be detrimental to the smooth running of the adjustment movement. The same is true of an arrangement, according to which the hollow shaft servo motor for the second slide is preferably attached centrally to the second slide, while the ball screw is attached non-rotatably to a yoke plate, which is connected firmly to the first slide.

The ball screw interacting with the hollow shaft servo motor for the second slide may exhibit a large pitch in relation to conventional screw pitches, which amount to approximately 5 mm, said large pitch being between 20 and 35 mm, more preferably between 25 and 30 mm. The gear action obtained from this large ball screw pitch allows the peripheral edge of the spectacle lens requiring machining to be machined quickly and without risk of breakage or damage of the spectacle lens, wherein, due to the slight axial force applicable via the ball screw to the second slide, slippage of the spectacle lens clamped between the holding shafts during machining is also reliably prevented. Such slippage must not occur for example under any circumstances if the spectacle lens to be machined comprises a close-focus portion aligned in angularly precise manner relative to the optical axis or a cylindrical or prismatic ground surface, the axial position of which must be in a predetermined relationship to the position of the spectacle lens mounted in the spectacle frame. In addition to this feed movement precision during machining, which is beneficial to control of the machining process, the gear action of the large ball screw pitch has the additional advantage that the adjustment movements of the second slide may proceed very quickly.

The tool post with the edge-machining tool may be appropriately located in the working chamber, which is separated from the axis system by means of a sliding member surrounding the second slide and rolling lobe or expansion bellows, which are arranged between the sliding member and the tool post. These separating measures are advantageously beneficial to the smooth-running of the adjustment and feed movements.

The first direction may extend vertically, while the second direction may extend horizontally. The vertical arrangement of the holding shafts for the optical lens to be machined, which is due to the parallelism between first direction and rotational workpiece axis, has the advantage that automatic loading of the device may be more readily managed by means of suitable handling apparatus, as would appropriately be provided in industrial manufacture.

A weight counterbalancing means is advantageously provided for weight counterbalancing for the slides, one end of which means is preferably supported centrally on the base frame while another end thereof is preferably connected centrally with the first slide. On the basis of this embodiment, the drive for the first slide does not therefore have to lift or hold the entire weight of the slides and the components attached thereto, which is advantageous particularly with regard to the maximum possible speeds and acceleration rates of the vertical movements. The central arrangement of the weight counterbalancing means relative to the base frame or the first slide also advantageously prevents the introduction of tilting movements into the first slide, which could be detrimental to the smooth-running of the vertical movements. The weight counterbalancing means used may be for example a pneumatic cylinder, which may be selectively pressurized by means of a pressure regulator, or a spring element. As an alternative to this embodiment, a counterweight for the slide with corresponding force deflection by means of a lever, for example, would also be feasible; such an embodiment is less preferable, however, than a purely linearly acting weight counterbalancing means due to the greater structural space requirements and because of the greater masses moved.

According to a further aspect of the present invention, in the case of a device for edge-machining an optical lens, in particular a spectacle lens, which may be clamped between two aligned holding shafts rotatable about the rotational axis of a workpiece, having a first slide, which is guided longitudinally displaceably on a base frame in a first direction parallel to the rotational axis of the workpiece, and a second slide bearing a tool post with an edge-machining tool for the optical lens, which is guided longitudinally displaceably on the first slide in a second direction perpendicular to the first direction in such a way that the (first) edge-machining tool may be brought into machining engagement with the optical lens, an additional machining means is fixed to the second slide, which means comprises at least one further edge-machining tool for the optical lens, which may be moved from a parked position into a machining position between the optical lens and the (first) edge-machining tool on the tool post.

Depending on the design of the additional edge-machining tool, the additional machining means may, as a means complementary to the first edge-machining tool provided on the tool post, be used to perform further machining processes which may be necessary, such as the formation of bores or channels in a spectacle lens, without the optical lens having to be removed from its chucking arrangement, which again speeds up edge-machining. For this, the existing axis system encompassing the base frame and the slides is advantageously used, i.e. additional controlled axes for the further edge-machining tool and the associated costs are unnecessary. If machining of the optical lens is performed with the first edge-machining tool provided on the tool post, the further edge-machining tool is located in its parked position. For further machining of the optical lens with the additional edge-machining tool, the latter is moved from its parked position into its machining position, in which it is located between the optical lens and the first edge-machining tool on the tool post, i.e. upstream of the first edge-machining tool when viewed in the direction of machining feed, such that said first machining tool is not in the way during further machining. It will be appreciated that the adjustment and feed movements of the further edge-machining tool may be controlled like the movements of the first edge-machining tool, wherein only the distance between the first edge-machining tool and the further edge-machining tool need be taken into account from the point of view of control.

In an advantageous embodiment, the additional machining means may comprise its own housing, which is flange-mounted on the second slide. Due to this modular construction, the device may optionally be retrofitted without difficulty with the additional machining means.

The additional machining means may comprise a swivel mechanism, by means of which the further edge-machining tool may be swiveled from the parked position into the machining position. Such a swivel mechanism advantageously allows movement of the further edge-machining tool with only one degree of freedom into the space between the first edge-machining tool and the optical lens to be machined, i.e. movement of the further edge-machining tool about the first edge-machining tool. The swivel mechanism may appropriately have a swivel lever mounted on the housing and a simple linear swivel drive, which is coupled at one end to the housing and at its other end to the swivel lever, wherein the linear swivel drive is preferably a pneumatic cylinder.

The further edge-machining tool is driven rotationally about an axis of rotation by means of a rotary actuator, which is in particular independent of the rotary actuator of the first edge-machining tool. The rotating further edge-machining tool may here for example be a drill or end-milling cutter for forming bores or grooves in the edge area of a spectacle lens, these being required for securing the spectacle lens in a spectacle frame. Grinding wheels for forming roof-shaped bevels and/or safety bevels on the spectacle lens edge are conceivable, as are tools for forming channels or grooves at the peripheral edge of the spectacle lens, with geometrically indeterminate cutting edges, such as sintered diamond wheels, or geometrically determinate cutting edges, such as saw blades or side milling cutters. The axis of rotation of the additional edge-machining tool may appropriately extend parallel to the axis of rotation of the first edge-machining tool provided on the tool post.

The rotary actuator for the further edge-machining tool may be fixed to the swivel lever, which simplifies the transmission of torque to the further edge-machining tool, wherein the axis of rotation of the rotary actuator extends perpendicularly to the axis of rotation of the further edge-machining tool. The latter is beneficial to a compact structure, wherein deflection of the torque may proceed simply by means of a pair of bevel gears or a flexible shaft.

Finally, in an advantageous further development of the device, the additional machining means may have a tool holder driven rotationally by means of the rotary actuator, which holder comprises a first clamping mechanism for radial chucking of an edge-machining tool and a second clamping mechanism for axial clamping of at least one edge-machining tool. By providing these different clamping mechanisms, both drills or end-milling cutters, for example, may be radially chucked and grinding wheels, saw blades or side milling cutters, for example, optionally even in combination, may be axially chucked, such that the additional machining means may be equipped in accordance with the respective requirements of the intended edge-machining.

At this point, it should also be mentioned that the above-described construction of the device having a tool post for a first edge-machining tool and an additional machining means for at least one further edge-machining tool enables the most varied tool combinations and thus the performance of the most varied machining processes. For instance, a combined tool with a grooved milling cutter may be provided as first edge-machining tool for producing the peripheral contour of and optionally a roof-shaped bevel on a spectacle lens and a grinding wheel for polishing the spectacle lens periphery optionally provided with a roof-shaped bevel, while the additional machining means may be equipped, as described above, with tools for forming bores, grooves, channels and/or bevels in the edge area of the spectacle lens. It is also feasible to transfer production of the peripheral spectacle lens contour to the additional machining means, wherein laser or water jet cutting heads may be used as the additional edge-machining tool, which heads serve in particular to perform parting cuts for forming the peripheral contour. Beveling and polish-machining of the spectacle lens periphery and bevel formation could in this instance be performed by means of the first edge-machining tool. The device described herein is particularly attractive for industrial use not least because of this flexibility with regard to the tools which may be used and the processes which may be performed.

BRIEF DESCRIPTION OF THE DRAWINGS

The invention will be described in more detail below in relation to a preferred exemplary embodiment and with reference to the attached, partially schematic drawings, in which.

DESCRIPTION OF THE PREFERRED EMBODIMENTS

Figure 1:
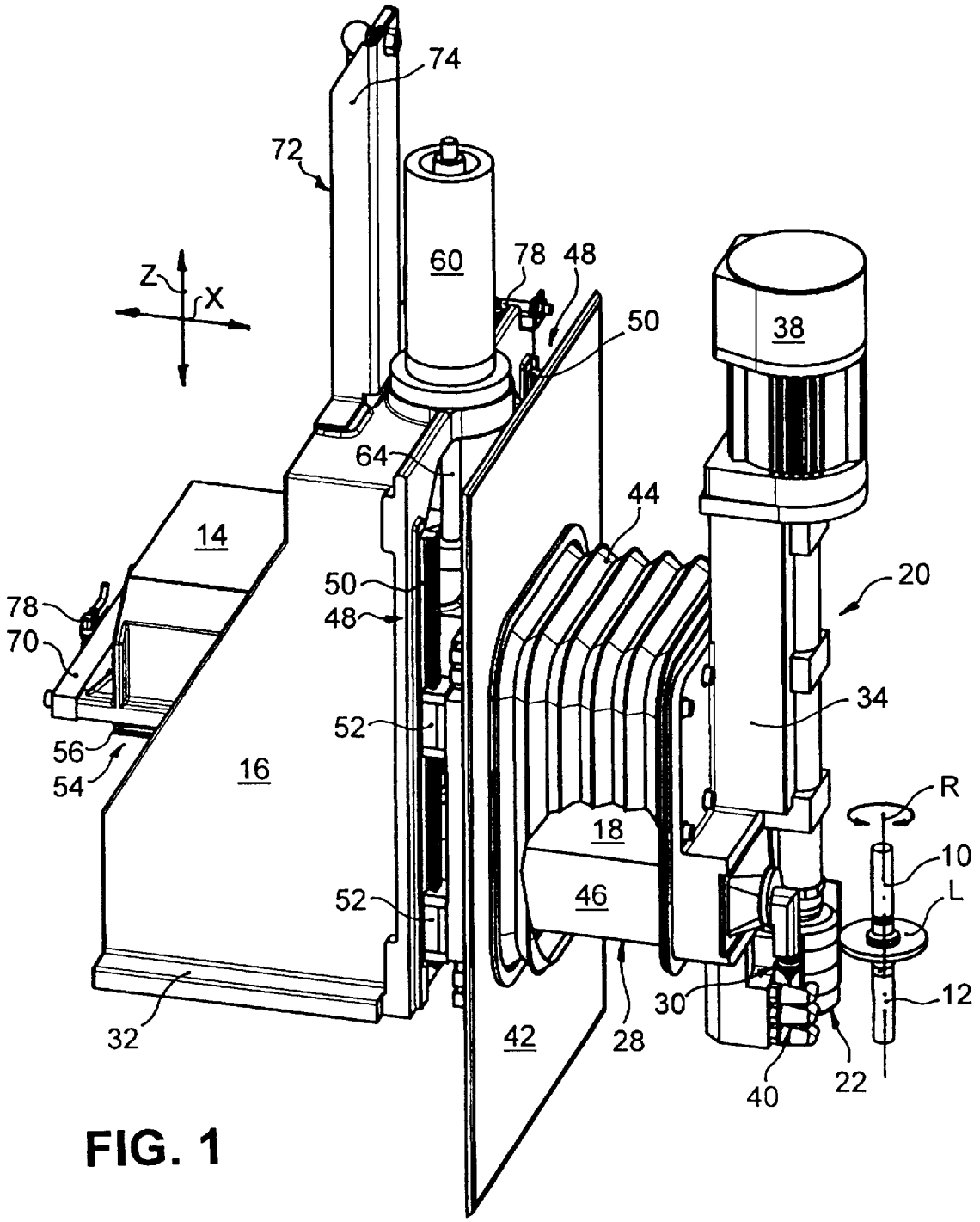
FIG. 1 is a perspective, partially broken-open view from the side/above of a device according to the invention.
Figure 2:
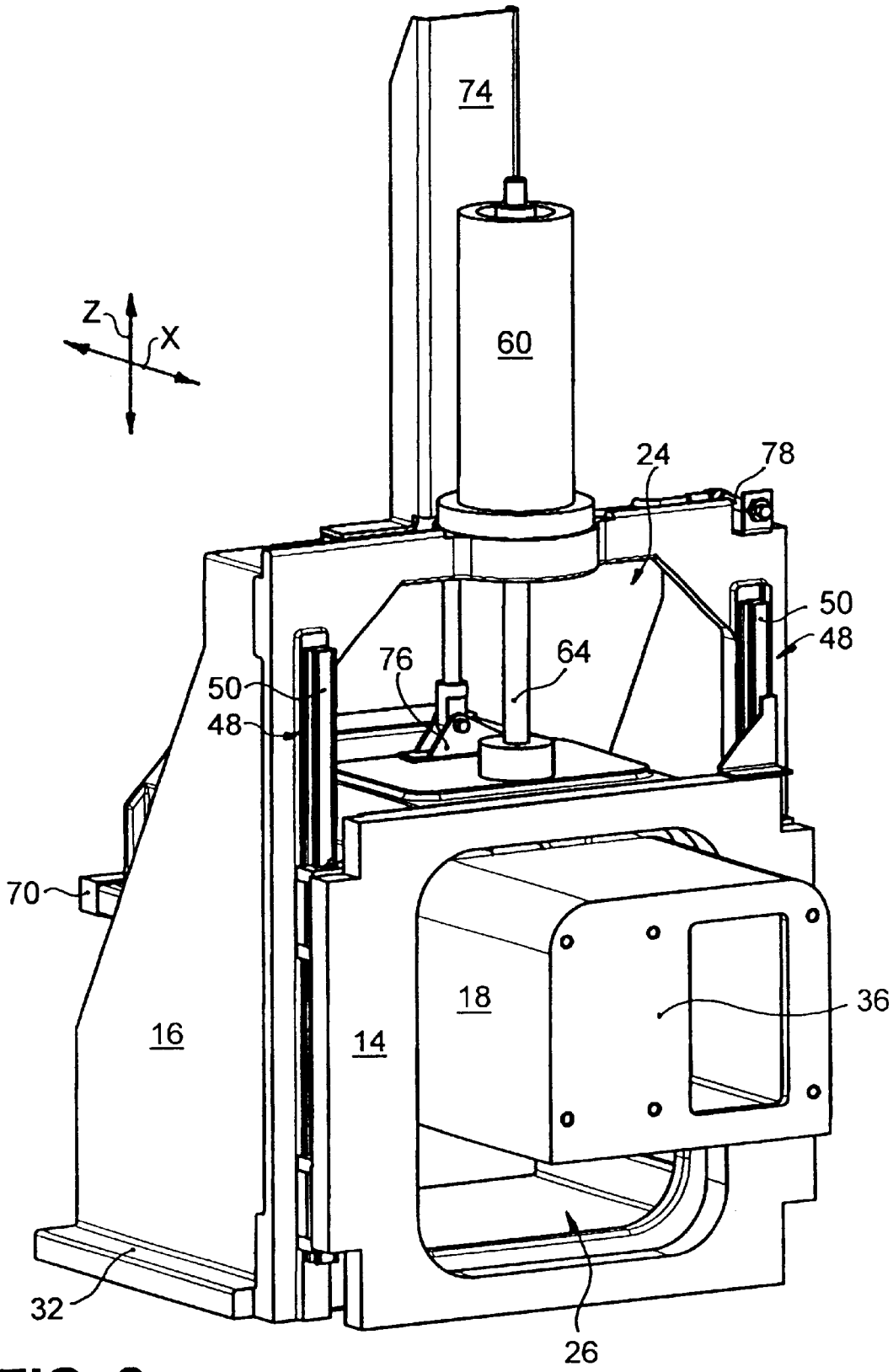
FIG. 2 is a perspective view from the front/above of the device according to FIG. 1, wherein some components shown in FIG. 1 have been omitted for the sake of clarity, such that substantially the base frame, the first and second slides and the guide and drive components of the device associated with the first slide are illustrated.
Figure 3:
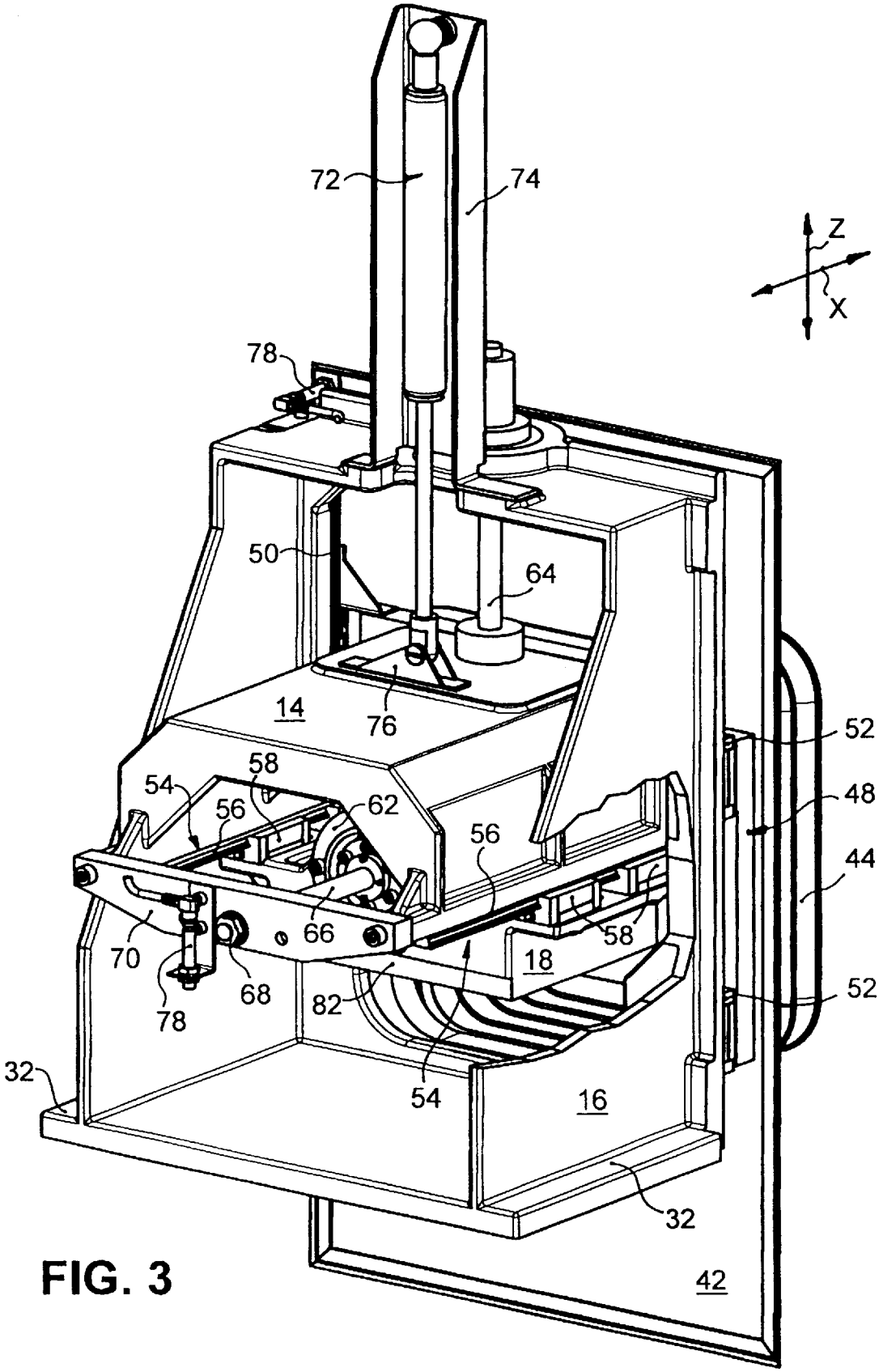
FIG. 3 is a perspective, partially broken-open view from the rear/above of the device according to FIG. 1, wherein, to simplify the illustration relative to FIG. 1, the drive for the first slide, the tool post, fixed to the second slide, for the first edge-machining tool and the additional machining means flange-mounted on the second slide have been omitted.

FIGS. 1 to 3 show a device for edge-machining an optical lens L in the form of a spectacle lens, which is clamped for machining between two axially aligned, i.e. coaxial, holding shafts 10, 12, illustrated merely schematically, which holding shafts 10, 12 may be rotated about a CNC-controlled rotational workpiece axis R. The device has a first or Z slide 14, which is guided longitudinally displaceably on a base frame 16 in a first direction parallel to the rotational workpiece axis R (in the exemplary embodiment shown in the vertical direction Z). The device additionally comprises a second or X slide 18, which bears a machining means generally designated as tool post 20, on which there is mounted a first edge-machining tool 22 for the optical lens L, shown merely schematically in FIG. 1. This slide 18 is guided longitudinally displaceably on the Z slide 14 in a second direction perpendicular to the first direction Z (in the exemplary embodiment shown the horizontal direction X). It is obvious that the first edge-machining tool 22 may be moved by means of a movement of the slides 18 and 14 in a radial direction relative to the optical lens L to be machined or parallel to the axis of rotation R of the optical lens L, in order to bring a particular longitudinal portion of the first edge-machining tool 22 into machining engagement with the optical lens L.

As is best seen from FIG. 2, the base frame 16 is substantially O-shaped when viewed in cross section and surrounds or encloses the Z slide 14, such that the latter may be moved in the vertical direction Z, i.e. up and down in a substantially O-shaped opening 24 in the base frame 16. The Z slide 14 is in turn substantially O-shaped when viewed in cross section and surrounds or encloses the X slide 18, such that the latter may be moved in the horizontal direction X, i.e. to and fro, in a substantially O-shaped recess 26 in the Z slide 14. Due to the substantially O-shaped construction of the base frame 16 and of the Z slide 14, there are achieved a high level of rigidity as a result of the closed force flow thus produced and very good thermal stability due to the symmetries consequently present, which ideally suits the device described herein for industrial use.

Irrespective thereof, it is also important for an additional machining means 28 to be fitted on the second or X slide 18 (as is described in more detail below in particular with reference to FIGS. 5 to 8), which comprises at least one further, in the exemplary embodiment shown several further, edge-machining tools 30 for the optical lens L, which may be moved from a parked position or rest position shown in FIGS. 1, 5 and 7 into a machining position illustrated in FIG.

8, in which the further edge-machining tools 30 are located between the optical lens L and the first edge-machining tool 22 or the tool post 20. Thus, the adjustment and feed movements of the further edge-machining tools 30 may proceed in the radial direction relative to the optical lens L to be machined or parallel to the axis of rotation R of the optical lens L with the X-Z axial control provided for the first edge-machining tool 22, i.e. without any major additional control effort for the further edge-machining tools 30.

The device shown in the Figures is a component of a lens edger, the other components of which are not shown here, in order to simplify the illustration. Thus, the base frame 16, constructed as a welded or cast structure, is attached to a machine frame (not shown) via flange portions 32, illustrated in FIGS. 1 to 3 and provided on both sides of the base frame 16, by means of suitable fastening elements, such as screws. Furthermore, a workpiece driving and chucking device for the optical lens L to be machined is attached to the machine frame, of which device only the holding shafts 10 and 12 are illustrated schematically in FIGS. 1 and 5, which may be driven synchronously about the rotational workpiece axis R and may be adjusted by means of a lifting device axially relative to one another for chucking of the optical lens L. Moreover, the machine frame bears the complete lens edger casing, an operating unit with input means (e.g. keypad, data reading apparatus etc.) and output means (e.g. screen, printer etc.) optionally together with handling or transport apparatus or systems for the optical lenses L to be machined or already machined, such as are described for example in the applicant's prior German patent application 100 29 966.0-22. Finally, a control box for accommodating a conventional industrial control system is attached to the machine frame and controls all the movements of the lens edger.

According to FIG. 1, the tool post 20 comprises a post housing 34, with which the tool post 20 is flange-mounted onto an end surface 36 of the X slide 18, which is most clearly visible in FIG. 2, such that the axis of rotation $C_1$ of the edge-machining tool 22 extends parallel to the rotational workpiece axis R. In the post housing 34 there is rotatably mounted a tool shaft, to which the first edge-machining tool 22 is attached and which may be driven by means of a rotary actuator 38, which is flange-mounted on the post housing 34 at the upper end, in FIG. 1, of said post housing 34. In the exemplary embodiment shown, the first edge-machining tool 22 takes the form of a combined tool with different machining portions, which may comprise milling, grinding and/or polishing portions. The possible tools and the edge-machining processes which may be performed therewith have long been known to the person skilled in the art and do not therefore need to be described in any more detail here.

Moreover, a nozzle arrangement 40 is illustrated in FIG. 1, which is attached to the post housing 34 and serves, during machining of the optical lens L, to spray cooling liquid into the area between the optical lens L and the first edge-machining tool 22, in order to cool tool and workpiece and to remove chips or the machining dust.

The holding shafts 10, 12 clamping the optical lens L project into a working chamber, in which the tool post 20 is also located, with the first edge-machining tool 22, and which is separated from the outside by the lens edger casing, not shown in the FIGS. The working chamber is separated by means of a telescopic plate or sliding member 42 together with expansion bellows 44 surrounding the X slide 18 and the additional machining means 28 from the axis system encompassing the base frame 16 and the slides 14, 18. The expansion bellows 44 are arranged between the sliding member 42 and the tool post 20 when viewed in the horizontal direction X and are attached with their ends to the sliding member 42 and the post housing 34 of the tool post 20 respectively. In FIG. 1 the expansion bellows 44 are shown broken open, in order to reveal a housing 46 of the additional machining means 28, which is flange-mounted onto the X slide 18 from below. Finally, the further edge-machining tools 30 of the additional machining means 28 protrude into the working chamber even in their parked position through a corresponding recess in the post housing 34 of the tool post 20. Suitable sealing measures are taken here, to prevent the cooling liquid being sprayed around in the working chamber during machining from penetrating into the housing 46 of the additional machining means 28.

As may in particular be inferred from FIGS. 2 and 3, a vertically arranged linear guide 48 for the Z slide 14 constructed as a welded or cast structure is provided on each side of the O-shaped opening 24 in the base frame 16. The linear guides 48 extend parallel to one another in symmetrical arrangement on the base frame 16. Each of the linear guides 48 for the Z slide 14 have a guide rail 50 attached to the base frame 16 by means for example of screws and two carriages or guide shoes 52 engaging with the guide rail 50. The guide shoes 52 are in turn attached in symmetrical arrangement at top and bottom to the Z slide 14 with the aid of screws for example.

Moreover, a linear guide 54 is provided on each side of the Z slide 14 for the X slide 18 constructed as a welded or cast structure. The linear guides 54 extend parallel to one another in symmetrical arrangement on the Z slide 14 and in a direction perpendicular to the orientation of the linear guides 48 on the base frame 16. Each of the linear guides 54 for the X slide 18 comprises a guide rail 56 attached from beneath to the Z slide 14 additionally stiffened by ribs by means for example of screws and two carriages or guide shoes 58 engaging with the guide rail 56. The guide shoes 58 are in turn attached in symmetrical arrangement from above to the X slide 18 with the aid of screws for example.

The linear guides 48 for the Z slide and the linear guides 54 for the X slide may comprise commercially available bought-in assemblies or components, wherein the guide shoes 52 or 58 may each be equipped with lubricated bead chains, which run in associated longitudinal grooves in a cross-sectionally dove-tailed portion of the corresponding guide rail 50 or 56 respectively in smooth-running manner in the longitudinal direction and in low-play manner in the transverse direction.

To produce the linear movements of the slides 14 and 18, CNC-controlled hollow shaft servo motors 60 and 62 respectively are provided, which each comprise rotatable nuts, not shown here, which are in active engagement with associated ball screws 64 and 66 respectively, which are clamped in non-rotatable manner at the ends. As shown in FIG. 2 in particular, the hollow shaft servo motor 60 for the Z slide 14 is flange-mounted at the top to the base frame 16. The associated ball screw 64 is attached non-rotatably to the Z slide. In the exemplary embodiment shown, the ball screw 63 engages centrally with the Z slide 14 when viewed in a direction perpendicular to the X and Z directions.

In the exemplary embodiment shown, the hollow shaft servo motor 62 for the X slide 18 is, as FIG. 3 shows, mounted centrally on the X slide 18 when viewed in the direction perpendicular to the X and Z directions, such that the hollow shaft servo motor 62 may move together with the X slide 18. The ball screw 66 associated with the hollow shaft servo motor 62 is attached by means of a nut 68 non-rotatably to a yoke plate 70, which extends in the manner of a bridge over the X slide 18 at the end of the X slide 18 remote from the tool post 20 in a direction perpendicular to the X and Z directions and is connected firmly therewith.

Figure 4:
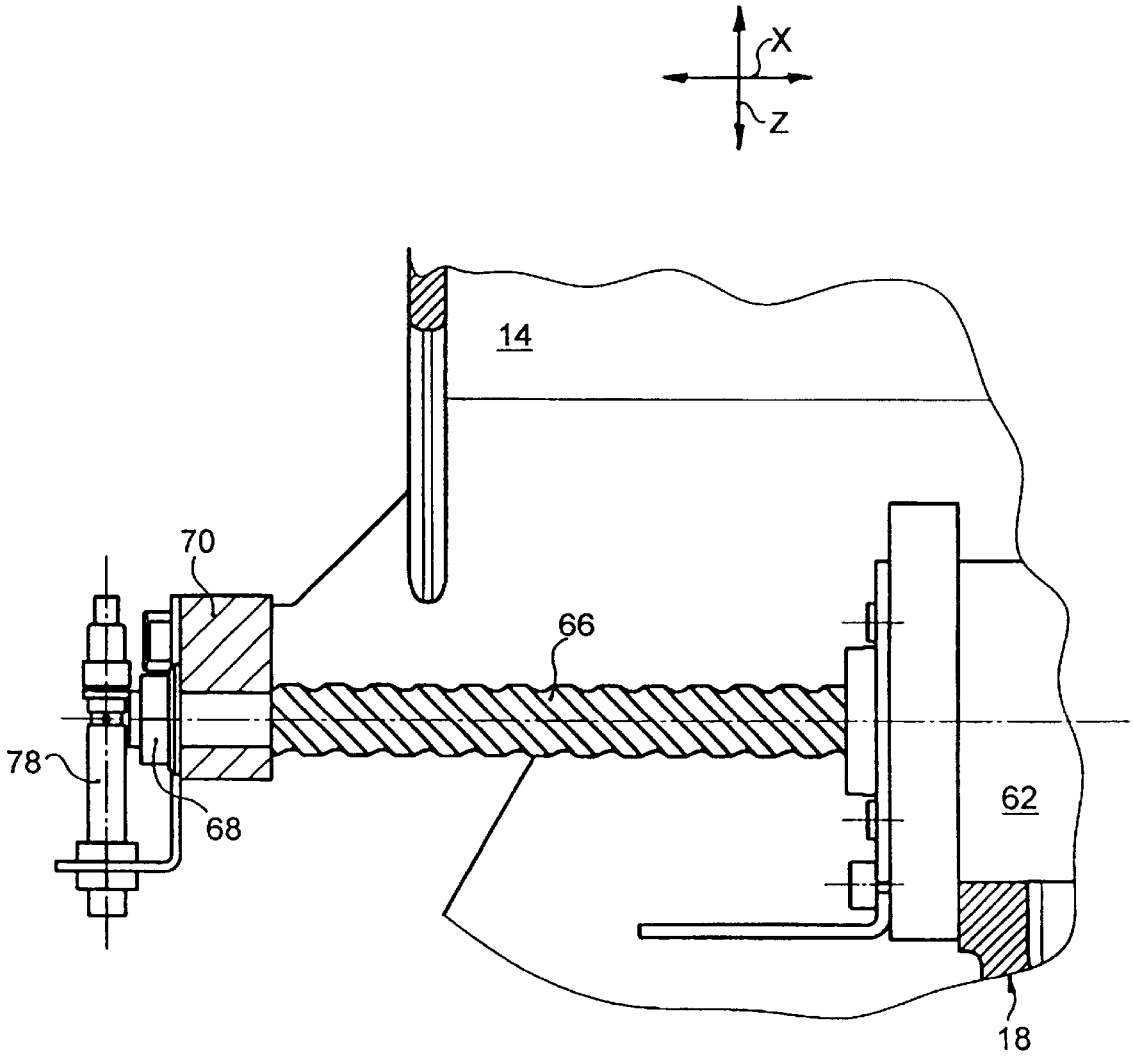
FIG. 4 is a partially sectional, broken away side view of the device, which shows the details of the drive components for the second slide on a larger scale than FIGS. 1 to 3.

While the ball screw 64 for the linear movement of the Z slide 14 exhibits a conventional thread pitch of for example 5 mm lift per revolution, the ball screw 66 for the linear movement of the X slide 18 has on the other hand, as FIG. 4 shows, a markedly larger pitch, which may amount to between 20 and 35 mm lift per revolution and, in the exemplary embodiment shown herein, is approximately 30 mm lift per revolution, such that only relatively small forces may be applied in the X direction as a result of the gear action of the ball screw 66 via the hollow shaft servo motor 62.

As is best seen in FIG. 3, a linearly acting weight balancing means 72 is here provided for weight balancing for the slides 14 and 18 and the components attached thereto, the one end of which weight balancing means 72 is supported centrally on the base frame 16 via a welded frame 74 attached to the base frame 16, while the other end of the weight balancing means 72 is connected centrally with the Z slide 14 via a pillow block 76 fixed to the Z slide 14. In the exemplary embodiment shown, the weight balancing means 72 is a gas tension spring arranged parallel to the hollow shaft servo motor 60 for the Z slide 14. Instead of a gas tension spring, however, the use of a pneumatic cylinder is also feasible, which may be selectively pressurized by means of a pressure regulator, in order to brake or hold the slides 14 and 18 variably in accordance with the respective requirements.

Finally, it should also be noted here, with regard to FIGS. 1 to 4, that signal transmitters 78 are also illustrated which, in cooperation with rotary transducers, not shown here, on the hollow shaft servo motors 60 and 62, serve in position detection and adjustment of the slides 14 and 18.

Figure 5:
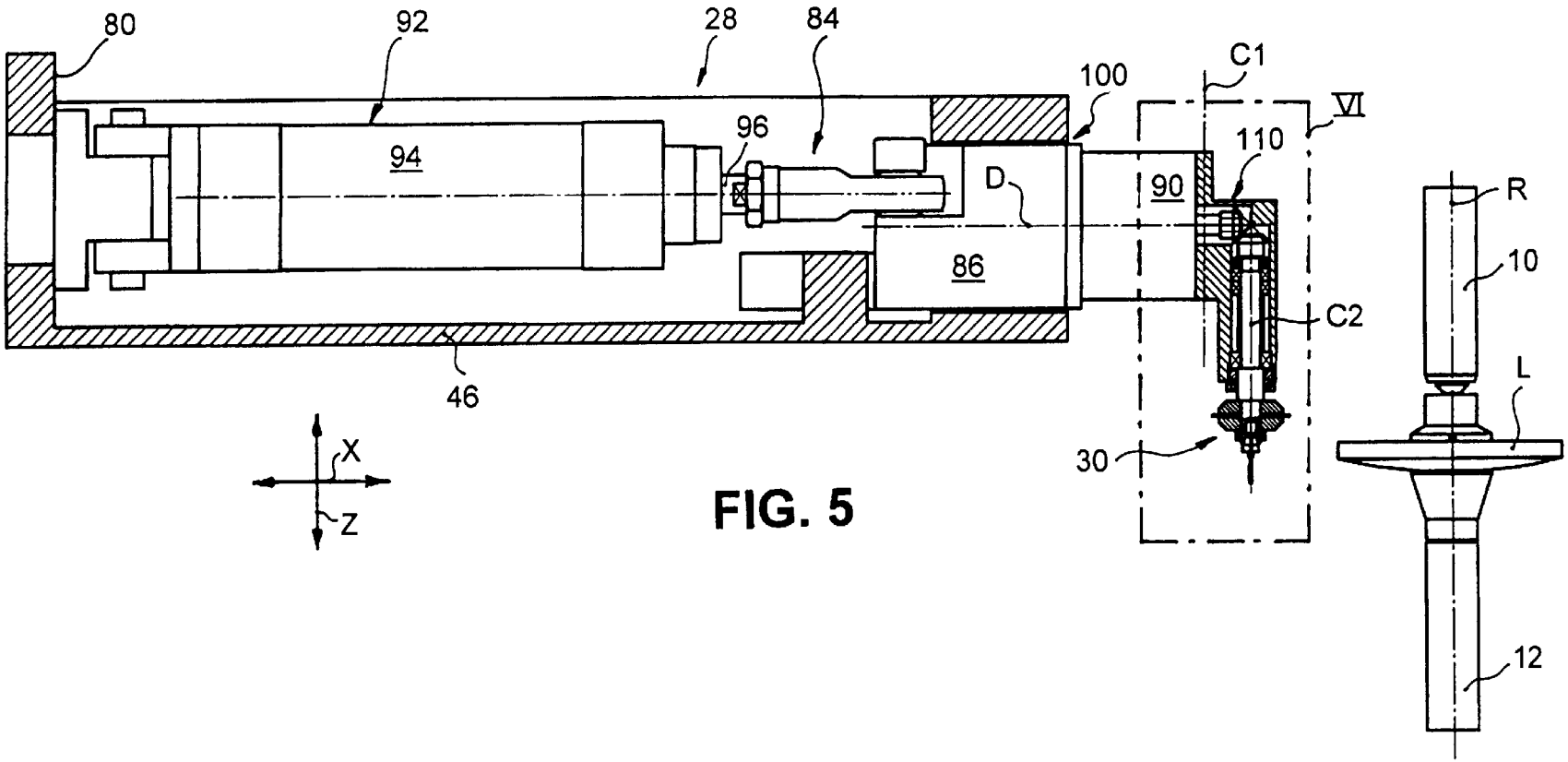
FIG. 5 is a partially sectional side view of the additional machining means removed from the second slide, the edge-machining tools of which means are located in their parked position, wherein the tool post for the first edge-machining tool is also indicated and a spectacle lens to be machined is shown clamped between the holding shafts.

FIGS. 5 to 8 show details of the additional machining means 28, the housing 46 of which comprises a stop face 80 at the left-hand end in FIG. 5, with which stop face 80 the additional machining means 28 comes to rest against a stop face 82, shown in FIG. 3, on the X slide 18 during mounting on the X slide, in order to position the additional machining means 28 on the X slide 18 in defined manner in the X direction.

Figure 7:
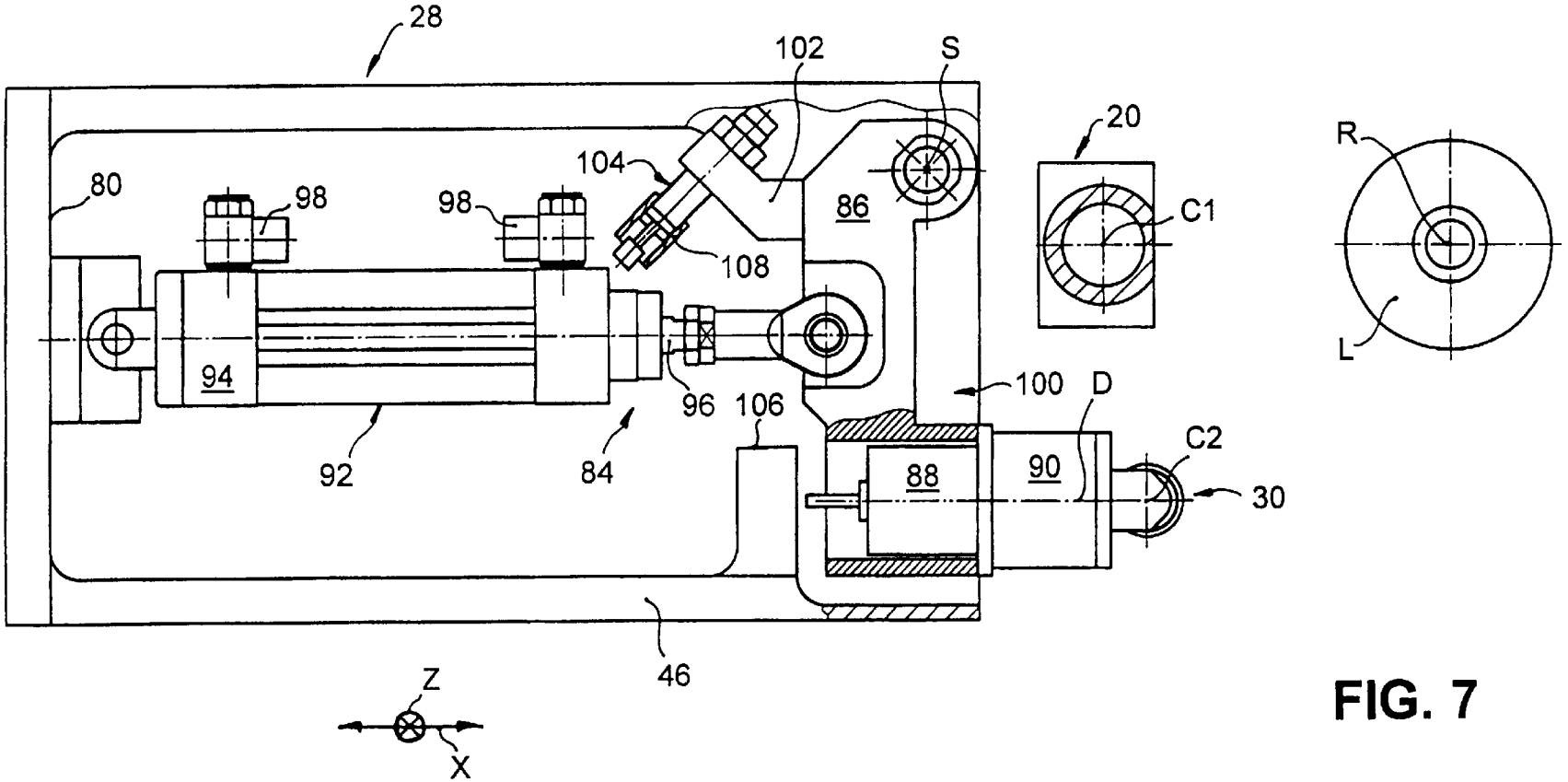
FIG. 7 is a partially broken-open plan view of the additional machining means according to FIG. 5, wherein the edge-machining tools are located in their parked position.
Figure 8:
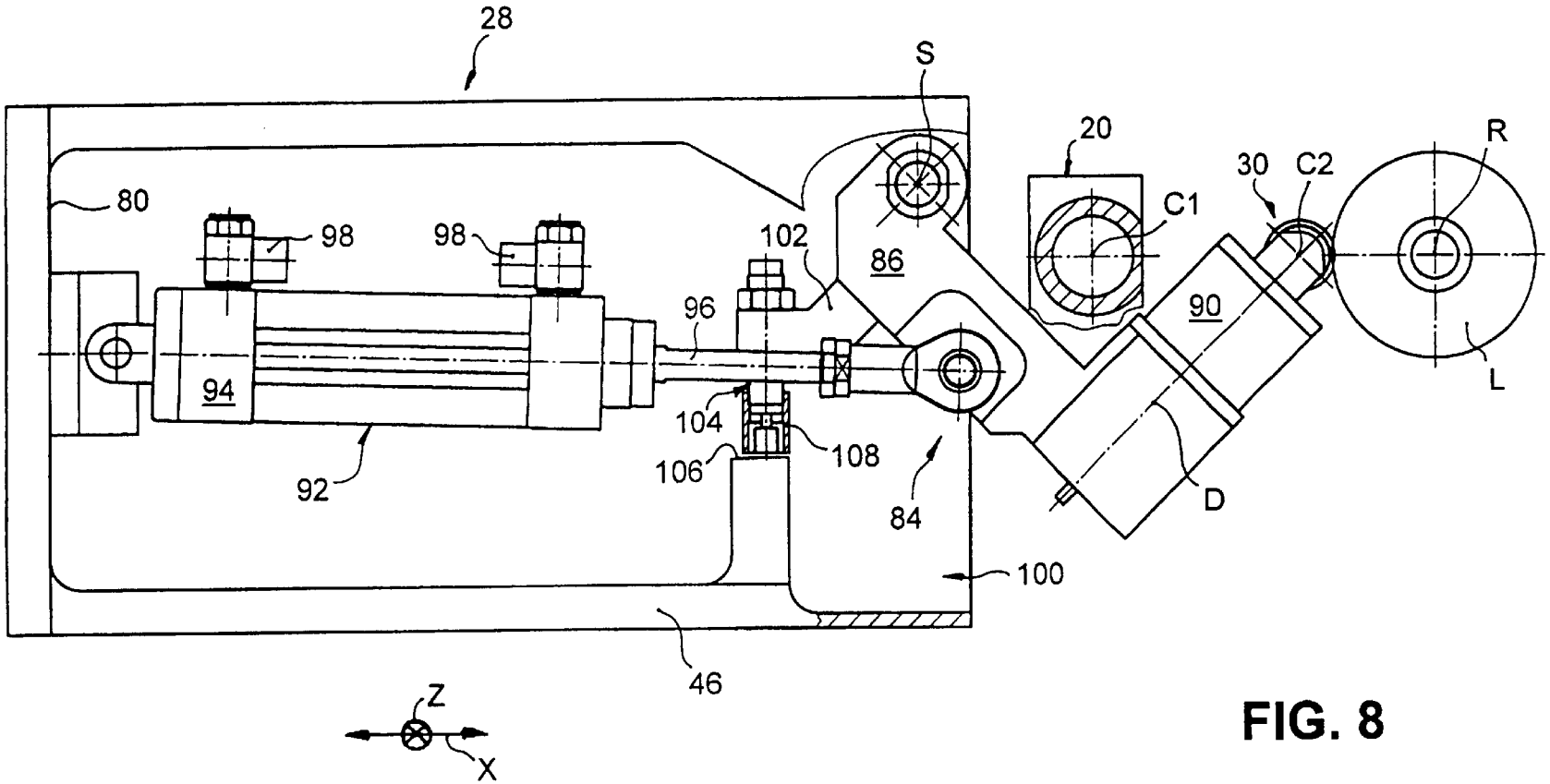
FIG. 8 is a partially broken-open plan view of the additional machining means according to FIG. 5, wherein the edge-machining tools thereof are located in their machining position.

According in particular to FIGS. 7 and 8, the additional machining means 28 has a swivel mechanism 84, by means of which the further edge-machining tools 30 may be swiveled from this parked position, shown in FIG. 7, into the machining position illustrated in FIG. 8. The swivel mechanism 84 comprises a swivel lever 86, which is mounted with one end against the right-hand top corner (in FIGS. 7 and 8) of the substantially cuboid housing 46 swivelably about a swivel axis S which extends in the Z direction. At its other end, the swivel lever 86 according to FIG. 7 is designed to accommodate a rotary actuator 88 for the further edge-machining tools 30, which rotary actuator 88 is flange-mounted on the swivel lever 86 by means of a drive housing 90. The axis of rotation D of the rotary actuator 88, which may be a motor driven electrically or pneumatically, extends perpendicularly to the swivel axis S.

Between the swivel axis S and the rotary actuator 88, a linear swivel drive 92 is coupled to the swivel lever 86 with its one end, while the other end of the swivel drive 92 is coupled substantially centrally to the left-hand wall (in FIGS. 5, 7 and 8) of the housing 46 of the additional machining means 28. In the exemplary embodiment shown, the swivel drive 92 is a pneumatic cylinder, the housing 94 of which is attached in articulated manner to the housing 46 of the additional machining means 28 and the length-adjustable piston rod 96 of which is attached in articulated manner to the swivel lever 86. It is obvious that the piston rod 96 may be extended and retracted out of and into the cylinder housing 94 by pressurization of the piston accommodated in the cylinder housing 94, said pressurization proceeding selectively in opposite directions via connections 98, in order to swivel the swivel lever 86 out of the parked position into the machining position and vice versa through an opening 100 in the housing 46 of the additional machining means 28.

Finally, it should be noted with regard to the swivel mechanism 84 that, in the vicinity of the swivel axis S, an arm 102 is fixed to the swivel lever 86, which arm 102 bears a shock absorber 104 at the end, the housing of which is attached to the arm 102 in adjustable or longitudinally adjustable manner. Upon swiveling of the swivel lever 86 out of the parked position into the machining position, the shock absorber 104 may come to rest against a stop face 106 provided on the housing 46 of the additional machining means 28. The end stop determining the machining position of the swivel lever 86 together with the stop face 106 is provided by a threaded bush 108 screwed onto the housing of the shock absorber 104. It is clear from FIG. 7 that the shock absorber 104 protrudes out of the threaded bush when the swivel lever 86 is in the parked position, so that the shock absorber 104 may absorb the impact of the threaded bush 108 against the stop face 106 upon swiveling of the swivel lever 86 into the machining position.

Figure 6:
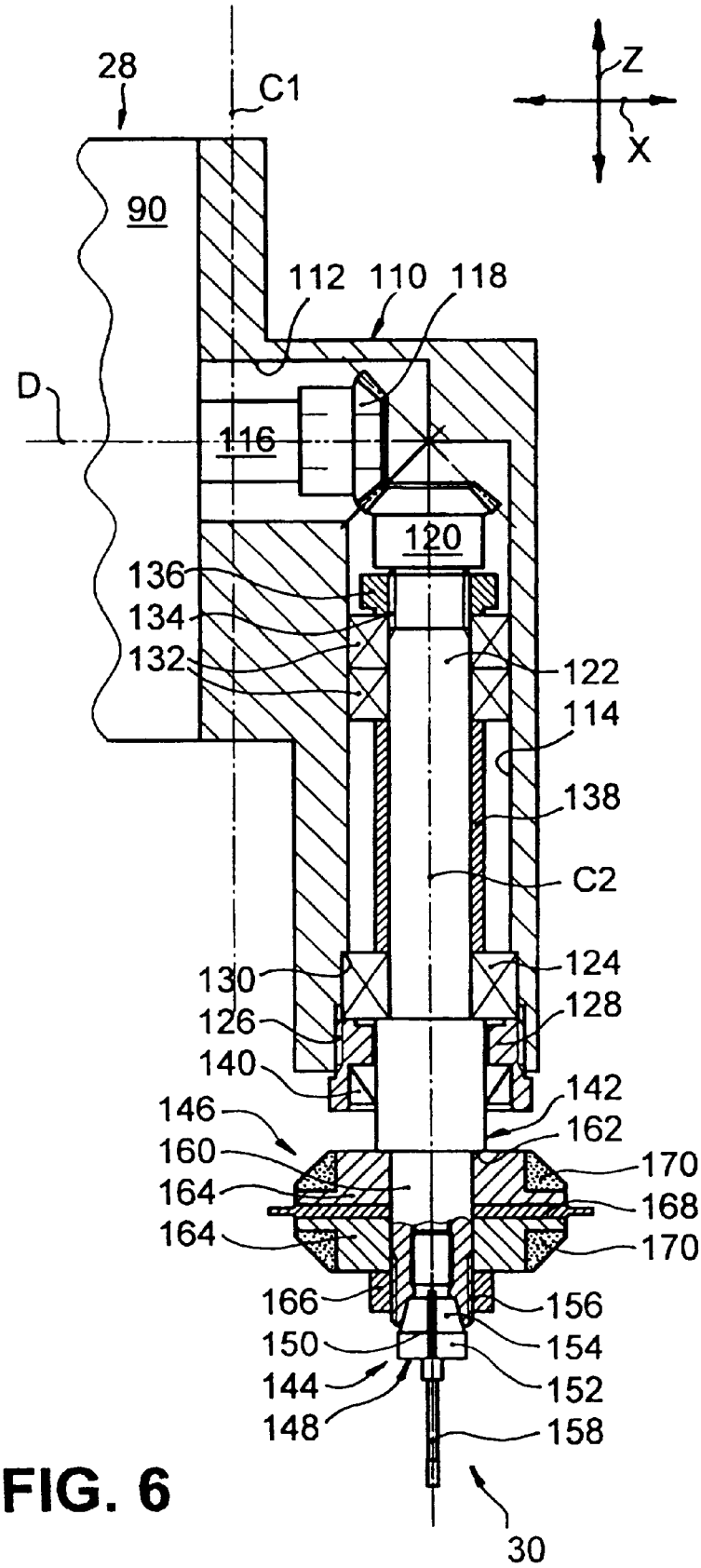
FIG. 6 is an enlarged representation of the detail VI of FIG. 5.

As may in particular be inferred from FIGS. 5 and 6, an angular head 110 is flange-mounted on the drive housing 90, which angular head 110 comprises two mutually connected bore portions 112 and 114, the central axes of which form a right angle. A shaft 116 of the rotary actuator 88, which is provided at the end with a bevel gear 118, projects into the bore portion 112. The bevel gear 118 meshes with a bevel gear 120 of the same diameter, which is fixed to one end of a shaft 122 mounted rotatably in the bore portion 114. The locating bearing 124 of the shaft 122 is clamped by means of an annular element 128 screwed into a threaded portion 126 of the bore portion 114 against an annular shoulder 130 of the bore portion 114. The two non-locating bearings 132 of the shaft 122 are clamped together with the locating bearing 124 by means of a shaft nut 136 screwed onto a threaded portion 134 of the shaft 122 on the bevel gear side via a spacer sleeve 138. Finally, the shaft 122 extends through the annular element 128 in sealed manner by means of a sealing element 140.

A tool holder 142 for the further edge-machining tools 30 driven rotationally by the rotary actuator 88 about the axis of rotation $C_2$ of the shaft 122 via the shaft 116, the bevel gear pair 118, 120 and the shaft 122 is fixed to the lower end of the shaft 122 in FIG. 6. It is clear from FIGS. 5 to 8 that the axis of rotation $C_2$ of the further edge-machining tools 30 extends at a right angle to the axis of rotation D of the rotary actuator 88 and parallel to the axis of rotation $C_1$ of the first edge-machining tool 22 and thus parallel to the axis of rotation R of the optical lens L. As is additionally clear from a comparison of FIGS. 7 and 8, the further edge-machining tools 30 may be swiveled from the parked position more or less about the tool post 20 or the first edge-machining tool 22 into the machining position, in which the axes of rotation $C_1$ and $C_2$ of the tools 22, 30 and the axis of rotation R of the optical lens L lie in a plane which extends parallel to a plane defined by the X and Z directions.

The tool holder 142 has a first clamping mechanism 144 for radial chucking of one of the further edge-machining tools 30 and a second clamping mechanism 146, independent of the first, for axial chucking of at least one other of the further edge-machining tools 30, as will be further described below.

The first clamping mechanism 144 has a collet chuck 148, which, starting from its lower end (in FIG. 6) provided with a longitudinal slot 150, comprises at its external circumference a key surface portion 152, a conical surface portion 154 and a threaded portion 156 and is provided at its internal circumference with a bore which serves to accommodate the further edge-machining tool 30 here constructed as an end-milling cutter 158. It is clear from FIG. 6 that, during screwing of the threaded portion 156 of the collet chuck 148 into a counter-threaded portion of a base member 160 of the tool holder 142, the conical surface portion 154 of the collet chuck 148 comes to rest against a conical counter-surface on the inner circumference of the base member 160. During further screwing-in of the collet chuck 148 into the base member 160, the longitudinal slot 150 extending beyond the conical surface portion 154 in the axial direction allows radially inwardly directed deformation of the collet chuck 148, whereby the end-milling cutter 158 is radially clamped. Instead of the end-milling cutter 158, it is here also possible to use a different tool, e.g. a drill, corresponding to the respective edge-machining requirements.

The second clamping mechanism 146 is formed by an annular shoulder 162 on the base member 160, optionally spacer disks 164 and a threaded ring 166, which, provided with a threaded portion at the inner circumference, may be screwed onto a counter-threaded portion at the external circumference of the lower end (in FIG. 6) of the base member 160. It is clear that one or more further edge-machining tools 30, in the exemplary embodiment shown a sintered diamond wheel 168, which is arranged between the spacer disks 164, may be axially chucked by clamping the sandwich or pile consisting of the spacer disks 164 and the diamond wheel 168 against the annular shoulder 162 of the base member 160 by screwing the threaded ring 166 onto the counter-threaded portion of the base member 160. Instead of the diamond wheel 168, a different tool, e.g. a saw blade or a side-milling cutter, may be axially chucked in accordance with the respective edge-machining requirements. In this connection, it should also be mentioned that the spacer disks 164 in the present case take the form of grinding wheels, i.e. are provided at the external circumference with abrasive members 170 which form a conical outer circumferential surface. Bevels or chamfers may be formed at the edge of the optical lens L by means of the abrasive members 170.

It will be appreciated that, to the person skilled in the art, with only a small amount of setting-up effort, bores, grooves, channels and/or bevels corresponding to the respective requirements may be formed in the edge area of the optical lens L by means of the above-described further edge-machining tools 30. Instead of rotating tools, cutting heads for laser or water jet cutting are also feasible as further edge-machining tools, which cutting heads could be fixed to the swivel lever 86.

In summary, a device is disclosed for edge-machining an optical lens, which may be clamped between two aligned holding shafts rotatable about the rotational axis of a workpiece, having a Z slide, which is guided longitudinally displaceably on a base frame in a Z direction parallel to the rotational axis of the workpiece, and an X slide bearing a tool post with an edge-machining tool, which is guided longitudinally displaceably on the Z slide in an X direction perpendicular to the Z direction in such a way that the edge-machining tool may be brought into machining engagement with the optical lens. For industrial use, according to the invention the base frame is of substantially O-shaped construction and surrounds the Z slide, which is likewise of substantially O-shaped construction and surrounds the X slide. In addition or as an alternative thereto, provision is made for an additional machining means to be fixed to the X slide, which means comprises at least one further edge-machining tool, which may be moved from a parked position into a machining position between the lens and the edge-machining tool on the tool post.

We claim:

1. A device for edge-machining an optical lens, which may be clamped between two aligned holding shafts rotatable about a rotational axis of a workpiece, having a first slide, which is guided longitudinally displaceably on a base frame in a first direction parallel to the rotational axis of the workpiece, and a second slide bearing a tool post with an edge-machining tool for the optical lens, which slide is guided longitudinally displaceably on the first slide in a second direction perpendicular to the first direction in such a way that the edge-machining tool may be brought into machining engagement with the optical lens; wherein the base frame is of substantially O-shaped construction and surrounds the first slide, and wherein the first slide is likewise of substantially O-shaped construction and surrounds the second slide.

2. A device according to claim 1, wherein the base frame has two sides and a linear guide for the first slide is provided on each side of the base frame, the linear guides extending parallel to one another on the base frame.

3. A device according to claim 2, wherein each linear guide for the first slide comprises a guide rail attached to the base frame and two guide shoes engaging with the guide rail, which guide shoes are fixed to the first slide in symmetrical arrangement.

4. A device according to claim 1, wherein the first slide has two sides and wherein a linear guide for the second slide is provided on each side of the first slide, the linear guides extending parallel to one another on the first slide.

5. A device according to claim 4, wherein each linear guide for the second slide comprises a guide rail attached to the first slide and two guide shoes engaging with the guide rail, which guide shoes are fixed to the second slide in symmetrical arrangement.

6. A device according to claim 1, wherein the first slide is movable by means of a hollow shaft servo motor, which comprises a rotatable nut, which is in active engagement with a non-rotatable ball screw.

7. A device according to claim 1, wherein the second slide is movable by means of a hollow shaft servo motor, which comprises a rotatable nut, which is in active engagement with a non-rotatable ball screw.

8. A device according to claim 6, wherein the hollow shaft servo motor for the first slide is attached to the base frame, while the ball screw is attached non-rotatably and centrally on the first slide.

9. A device according to claim 7, wherein the hollow shaft servo motor for the second slide is attached centrally to the second slide, while the ball screw is attached non-rotatably to a yoke plate, which is connected firmly to the first slide.

10. A device according to claim 7, wherein the ball screw interacting with the hollow shaft servo motor for the second slide exhibits a relatively large pitch, which is between 20 and 35 mm.

11. A device according to claim 1, wherein the tool post with the edge-machining tool is located in a working chamber, which is separated from the axis system encompassing the base frame and the slides by means of a sliding member fixed to the first slide and rolling lobe, optionally to expansion bellows surrounding the second slide, these latter being arranged between the sliding member and the tool post.

12. A device according to claim 1, wherein the first direction extends vertically, while the second direction extends horizontally.

13. A device according to claim 12, wherein a weight counterbalancing means is provided for weight counterbalancing for the first and second slides, the weight counterbalancing means having one end which is supported centrally on the base frame and having another end which is connected centrally with the first slide.

14. A device according to claim 1, wherein an additional machining means is fixed to the second slide, which means comprises at least one further edge-machining tool for the optional lens, which is movable from a parked position into a machining position between the optical lens and the edge-machining tool on the tool post.

15. A device according to claim 14, wherein the additional machining means comprises a housing, which is flange-mounted on the second slide.

16. A device according to claim 14, wherein the additional machining means comprises a swivel mechanism, by means of which the further edge-machining tool may be swiveled from the parked position into the machining position.

17. A device according to claim 16, wherein the swivel mechanism has a swivel lever and a linear swivel drive with two ends, the swivel lever being mounted on the housing, and the swivel drive being coupled at one of its ends to the housing and at its other end to the swivel lever, and wherein the linear swivel drive is a pneumatic cylinder.

18. A device according to claim 14, wherein the further edge-machining tool is driven rotationally about an axis of rotation by means of a rotary actuator.

19. A device according to claim 18, wherein the axis of rotation of the further edge-machining tool extends parallel to the axis of rotation of the edge-machining tool provided on the tool post.

20. A device according to claim 18, wherein the rotary actuator for the further edge-machining tool is fixed to the swivel lever, the rotary actuator having an axis of rotation extending perpendicularly to the axis of rotation of the further edge-machining tool.

21. A device according to claim 18, wherein the additional machining means has a tool holder driven rotationally by means of the rotary actuator, which holder comprises a first clamping mechanism for radial chucking of an edge-machining tool and a second clamping mechanism for axial chucking of at least one edge-machining tool.

22. A device for edge-machining an optical lens, which may be clamped between two aligned holding shafts rotatable about a rotational axis of a workpiece, having a first slide, which is guided longitudinally displaceably on a base frame in a first direction parallel to the rotational axis of the workpiece, and a second slide bearing a tool post with an edge-machining tool for the optical lens, which slide is guided longitudinally displaceably on the first slide in a second direction perpendicular to the first direction in such a way that the edge-machining tool may be brought into machining engagement with the optical lens; wherein an additional machining means is fixed to the second slide, which means comprises at least one further edge-machining tool for the optical lens, which is movable from a parked position into a machining position between the optical lens and the edge-machining tool on the tool post.

23. A device according to claim 22, wherein the additional machining means comprises a housing, which is flange-mounted on the second slide.

24. A device according to claim 22, wherein the additional machining means comprises a swivel mechanism, by means of which the further edge-machining tool may be swiveled from the parked position into the machining position.

25. A device according to claim 24, wherein the swivel mechanism has a swivel lever and a linear swivel drive with two ends, the swivel lever being mounted on the housing, and the swivel drive being coupled at one of its ends to the housing and at its other end to the swivel lever, and wherein the linear swivel drive is a pneumatic cylinder.

26. A device according to claim 22, wherein the further edge-machining tool is driven rotationally about an axis of rotation by means of a rotary actuator.

27. A device according to claim 26, wherein the axis of rotation of the further edge-machining tool extends parallel to the axis of rotation of the edge-machining tool provided on the tool post.

28. A device according to claim 26, wherein the rotary actuator for the further edge-machining tool is fixed to the swivel lever, the rotary actuator having an axis of rotation extending perpendicularly to the axis of rotation of the further edge-machining tool.

29. A device according to claim 26, wherein the additional machining means has a tool holder driven rotationally by means of the rotary actuator, which holder comprises a first clamping mechanism for radial chucking of an edge-machining tool and a second clamping mechanism for axial chucking of at least one edge-machining tool.

* * * * *